United States Patent [19]

Horowitz

[11] 3,969,225

[45] July 13, 1976

[54] DIFFERENTIAL SEPARATION OF PARTICULATES BY COMBINED ELECTRO-STATIC AND RADIO FREQUENCY MEANS

[75] Inventor: Arnold S. Horowitz, Scarsdale, N.Y.

[73] Assignee: I. Jordan Kunik, New York, N.Y. ; a part interest

[22] Filed: Aug. 28, 1975

[21] Appl. No.: 608,548

Related U.S. Application Data

[63] Continuation-in-part of Ser. No. 457,981, April 4, 1974, abandoned.

[52] U.S. Cl. ..... 209/127 A; 209/11; 219/10.47

[51] Int. Cl.[2] ..... B03C 7/00

[58] Field of Search ..... 209/3, 4, 11, 10, 127 A, 209/129, 128, 238, 127 R; 219/10.47, 10.81, 10.69, 10.71, 10.55 A; 15/1.5; 204/308; 131/121, 140 P, 146

[56] References Cited

UNITED STATES PATENTS

| | | | |
|---|---|---|---|
| 827,115 | 7/1906 | Pickard | 209/127 A X |
| 1,386,287 | 8/1921 | Sutton et al. | 209/127 A X |
| 2,757,266 | 7/1956 | Manwaring | 219/10.47 |
| 3,097,160 | 7/1963 | Rich | 209/11 X |
| 3,463,310 | 8/1969 | Ergun et al. | 209/11 X |
| 3,701,875 | 10/1972 | Witsey et al. | 219/10.81 |
| 3,837,481 | 9/1974 | Stungis et al. | 209/4 |

FOREIGN PATENTS OR APPLICATIONS

| | | | |
|---|---|---|---|
| 144,932 | 3/1949 | Australia | 209/127 A |

*Primary Examiner*—Frank W. Lutter
*Assistant Examiner*—Ralph J. Hill
*Attorney, Agent, or Firm*—I. Jordan Kunik

[57] ABSTRACT

A system and apparatus for separating different types of particulate materials selectively by subjecting a moving mixture of said materials to a combined applied direct current (D.C.) voltage and radio frequency (RF) electric field, thereby causing the particles to become differentially heated in accordance with the respective dielectric constants and loss factors of the various particles. The separation is accomplished as a result of the differential loss of electrostatic charges impressed upon the different types of materials in accordance with their respective physical and chemical characteristics. During this process, there is no permanent or irreversible alteration in the chemical and physical properties of the particulate materials.

13 Claims, 7 Drawing Figures

FIG. 1
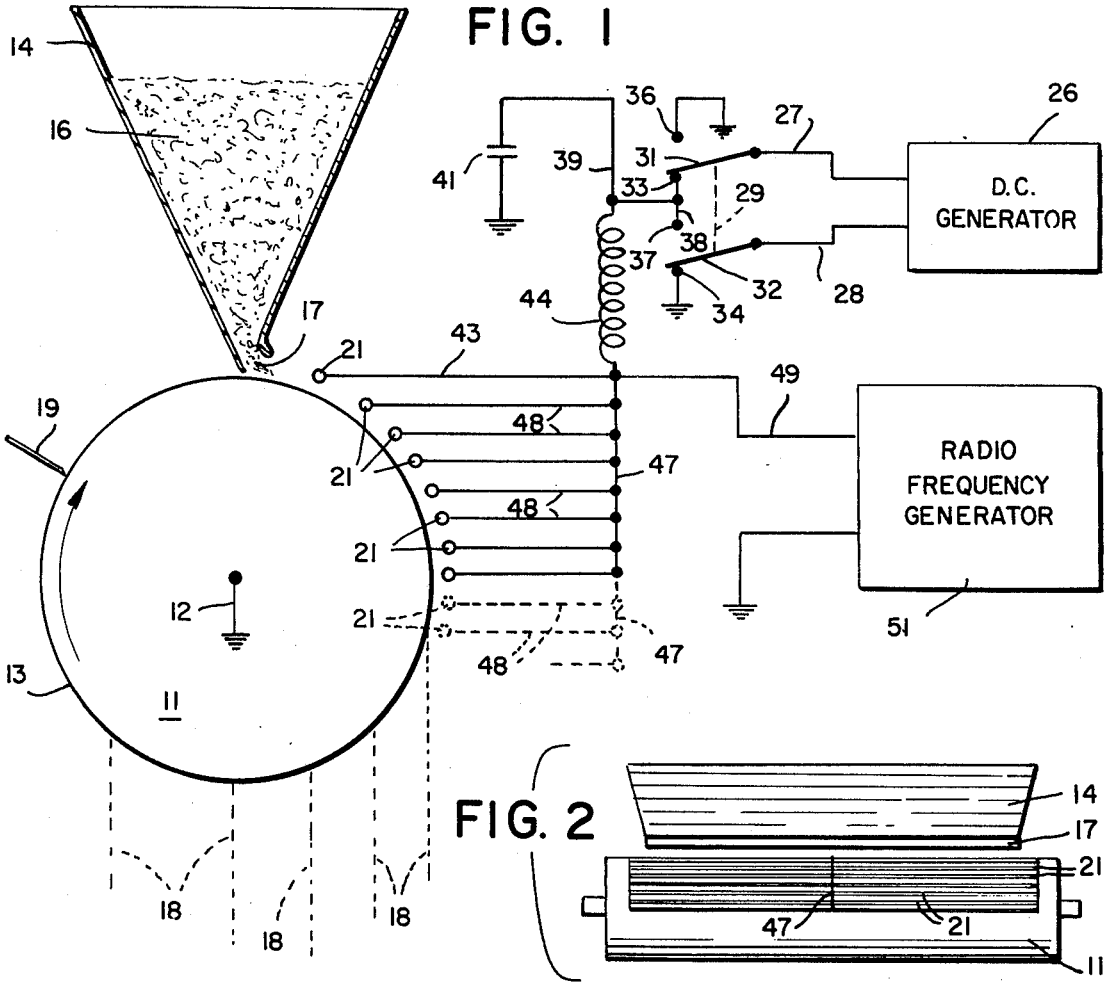
FIG. 2
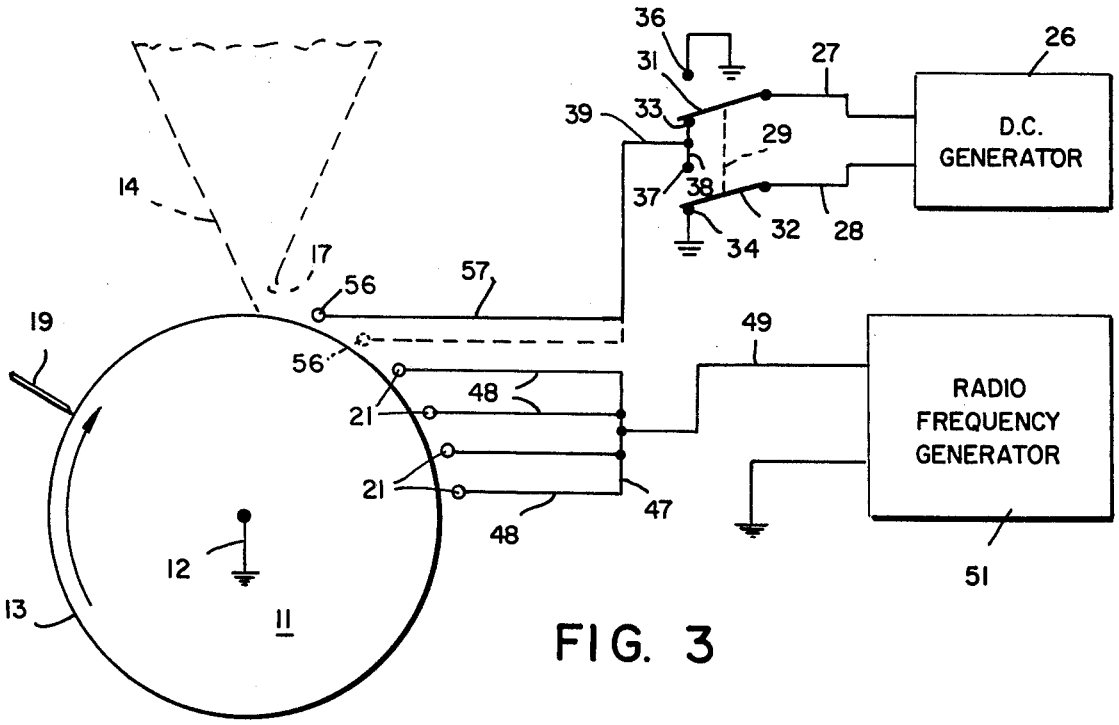
FIG. 3

FIG. 4
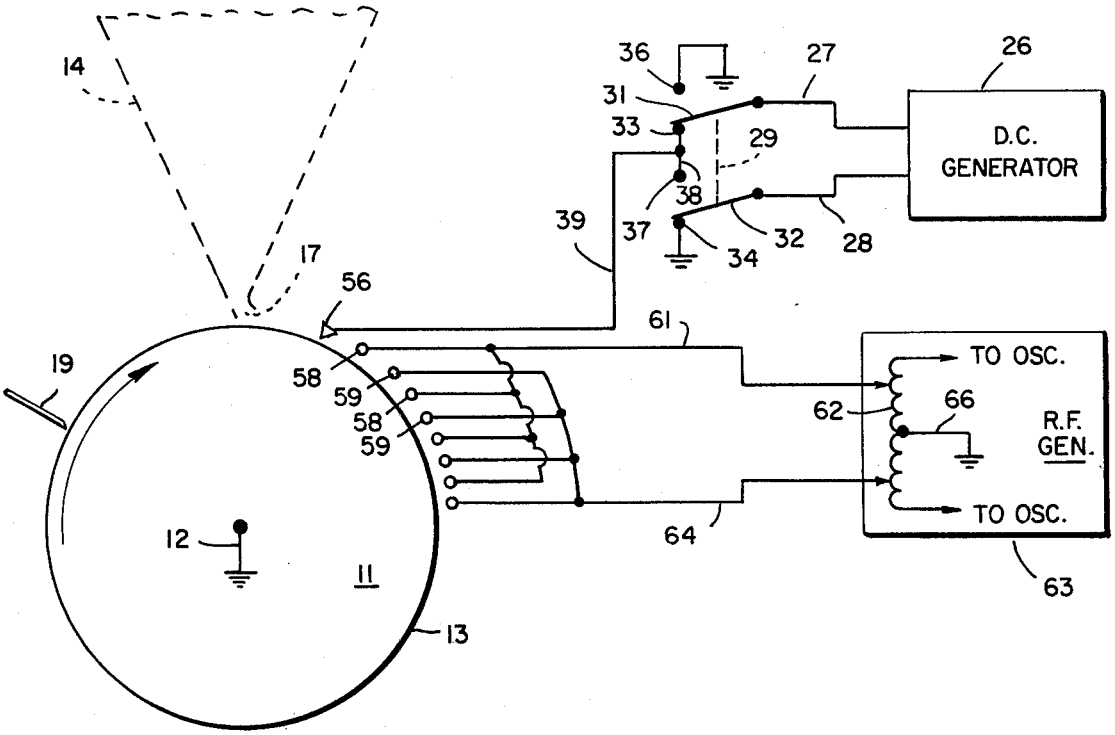
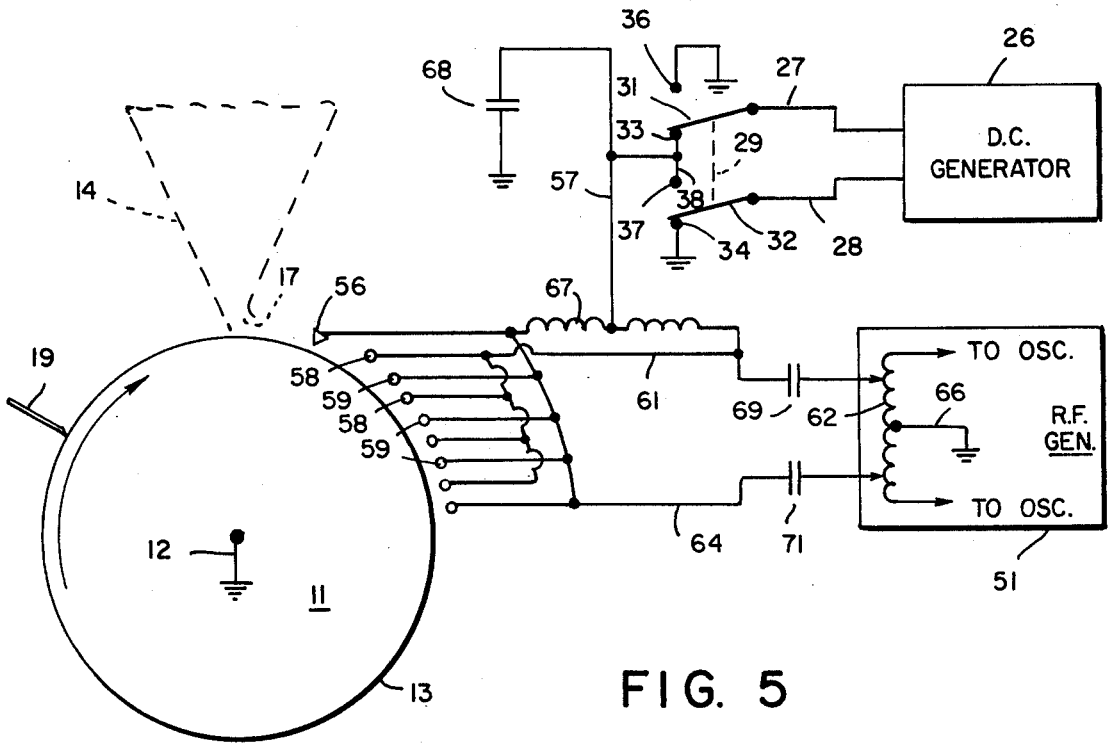
FIG. 5

DIFFERENTIAL SEPARATION OF PARTICULATES BY COMBINED ELECTRO-STATIC AND RADIO FREQUENCY MEANS

CROSS REFERENCE TO RELATED APPLICATION

This application is a continuation-in-part of an application filed by Arnold S. Horowitz, Ser. No. 457,981, filed Apr. 4, 1974, entitled "Differential Separation of Particulates by Combined Electrostatic and Radio Frequency Means, now abandoned."

BACKGROUND OF THE INVENTION

1. Field of the Invention

This invention relates to the selective and differential separation from a random mixture of heterogeneous particles substantially discrete groups of homogeneous particles, with each group being dissimilar from any other group. This is accomplished by subjecting a moving heterogeneous mixture of moving particles to the combination of an electrostatic charge and a radio frequency field whereby said particles become differentially heated.

As a result of this synergistic treatment, the different types of particles subsequently lose their respective electrostatic charges differentially in accordance with their respective chemical and physical properties. Selective separation is achieved by the different periods of time in which the loss of the electric charge is manifested for each particle type.

2. Description of the Prior Art

The separation of metallic or non-metallic particles has heretofore been accomplished by subjecting the moving heterogeneous mass of particles to an electrostatic charge. Thus, the apparatus could separate conductive material from non-conductive material. When it is required, however, to differentiate and selectively separate different types of non-conductive material, the electrostatic process alone is unequal to that purpose.

In other systems for making selective separations from heterogeneous mixtures of conductive and non-conductive materials where differential heating of said particles has been employed, it has been necessary to utilize complex and expensive systems for capturing the differentially heated particles and releasing them by such means as fluidized streams and temperature-sensitive adhesive carriers to which the particles adhere and are released selectively in accordance with the induced temperatures of the particles.

SUMMARY OF THE INVENTION

The present invention obviates the drawbacks and deficiencies of prior art systems and apparatus and simplifies the process for separation of homogeneous groups of particles from a heterogeneous mixture of particles of two or more materials. The process of the invention is carried out in a dry state and without utilizing liquids or gases and it dispenses with the use of temperature-sensitive adhesive carriers to achieve the separation. The system of the present invention and the apparatus for performing the separation process comprises moving the heterogeneous mass of particles over the surface of a materials carrier such as a rotating drum, conveyor belt, or the like, impressing upon the moving mass of particles an electrostatic charge, and subjecting the moving mass of particles also to a radio frequency electric field to cause the particles to become heated. The electrostatic charge can be applied before, after, or simultaneously with the application of the radio frequency electric field. This combined treatment will have negligible effect upon the metallic particles in the homogeneous mass and thus the metallic particles will not adhere to the drum and will fall off at an early stage of the process. The remaining non-conductive materials such as different types of plastics which adhere to the surface of the drum by virtue of the electrostatic charge imposed thereon, will be heated dielectrically to varying degrees depending upon the particular chemical and physical nature of the particles in each respective homogeneous class of materials.

According to the present invention, a moving mixture of two or more different particulate types of materials is both charged electrostatically and is subjected to RF electric heating whereby the different classes of materials will lose their respective charges and adherence at different time rates and will be selectively collected in successive spaced receptacles.

The particles in an agglomerate of non-conducting materials will accept an electrostatic charge in proportion to the applied D.C. voltage, to the combination dielectric constants and loss factors of the respective particles, and to the specific temperature. The length of time each particle holds its charge is governed by its chemical and physical properties and by temperature and relative humidity. Since the humidity is generally uniform to the mix, the temperature will have the greatest effect and will be the determining factor. The chemical and physical natures of the respective particles will determine their power absorption characteristics and their ability to convert said power into heat.

When a mixture of materials with different dielectric constants and loss factors are heated dielectrically in a radio frequency electric field while in an electrostatic field, the particles will give up their charges and will separate from the rest of the mix at different time intervals in accordance with said different dielectric constants and loss factors thereby effecting differential separation of different types of particles. Radio transparent and radio opaque material, and materials that exhibit various degrees of radio opacity, can be separated from each other at successive stages of the processing cycle because, with equal power applied to each type of material for equivalent time periods, each type will heat to a different temperature. Since all of the materials in the mix have been exposed to a high voltage direct current electrostatic charging system, each charged particle would give up its charge in a time interval in accordance with its own combined characteristics of dielectric constant and loss factor. In the separating process herein, the metallic particles will not be appreciably affected by the electrostatic field or by the RF electric field and will be the first to drop off the drum or conveyor belt depending upon which method is used. The non-metallic particles will adhere to the carrier surface and remain on the surface until they give up their charge in accordance with the temperature factor and will drop off at separate successive respective areas in the processing cycle between the first drop off point and the last. Each dielectric material exhibits changes in either dielectric constant or loss factors, or both, in relation to temperature and frequency. Because of such changing characteristics while being subjected to a constant voltage radio frequency fluid, each material reaches its own characteristic temperature within a specific time span, and its ability to accept the D.C. electrostatic charge will be proportional to the achieved dielectric constant. Therefore, the loss of charge will now depend upon the total charge and the inherent loss characteristics of the material which, in turn, will determine the point at which it will separate from the carrier. Depending upon the types of materials that are to be separated from one another, the optimum radio frequency and voltage, as well as the optimum D.C. electrostatic voltage can be arrived at empirically.

The predetermined power of the radio frequency electric field applied to the mix and electrostatic charge in voltages, and the spacing of the electrodes will determine the rate of speed of the process and the efficiency of separation. The efficiency of separation can also be increased by selecting one or more frequencies of the radio frequency system to optimize selective heating of low loss materials, such as Teflon, polypropylene, and other nonconductors that might be found, for example, in a mixture of wire scrap, or in other material separation processing systems. By means of the present system described and claimed herein, there will result differential time losses of electrostatic charge in accordance with the respective dielectric energy absorption characteristics of the differential materials, thereby serving as the means for separating different homogeneous types of materials from a heterogeneous mixture of said materials.

Although the particles to be separated are subjected to the electrostatic charge and the radio frequency energy field whereby the particles become differentially heated during the separation process, nevertheless the treatment period is of comparatively short duration and the intensity of heating of the particles can be empirically controlled so that said particles resume substantially their original physical and chemical characteristics after they have been separated. The separation system described and claimed herein is nondestructive, in contrast to various other separating systems which permanently and irreversibly alter the chemical and physical properties of some of the particles which may consequently be rendered useless. Accordingly, after being subjected to the separation process herein, the various separated particles each have substantially the same physical and chemical characteristics as they had in the pre-treatment state. This consideration is important in the context of reclaiming and recycling useful materials for industrial and commercial purposes instead of going to waste or being used as uneconomic landfill, or the like.

These and other novel features and advantages of the present invention will be described and defined in the following specification and claims:

BRIEF DESCRIPTION OF THE DRAWINGS

FIG. 1 is a diagrammatic illustration of the apparatus of the present invention together with a schematic representation of the electrical circuitry connected therewith;

FIG. 2 is a side elevation in reduced scale of the hopper and drum shown in FIG. 1, some parts being omitted;

FIG. 3 is somewhat similar to FIG. 1, showing another embodiment of the invention;

FIG. 4 is a schematic view of an alternative electrical circuit working in conjunction with the drum;

FIG. 5 is a still further modification of the electrical circuit working in conjunction with the drum;

DESCRIPTION OF THE EMBODIMENTS OF THE INVENTION

Figure 6:
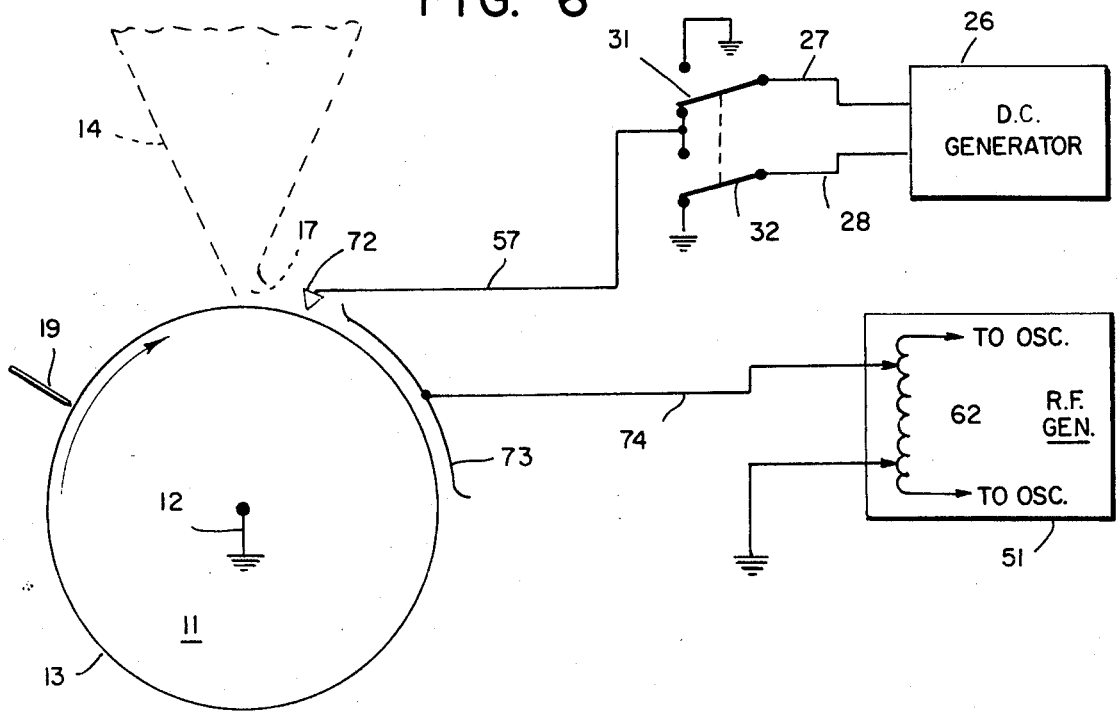
FIG. 6 is a still further modification of the electrical circuit working in conjunction with the drum.

Referring now to the drawings in detail, there is shown diagrammatically in FIG. 1 a rotatable drum 11 which is electrically grounded at 12 by suitable means known in the art. Drum 11 has a circular surface 13, also grounded at 12, and made of an electrically conductive material and which serves as a common electrode in the apparatus and process described herein.

Located above drum 11 is a hopper 14 into which various coarsely or finely divided materials 16 are introduced. The bottom of hopper 14 has an aperture 17 spaced somewhat apart from the top of drum 11 and through which the particulate materials 16 are discharged onto moving electrode 13. Located beneath drum 11 are a number of spaced partitions 18 into which the particles of different characteristics are discharged in accordance with the electrical process to which they are subjected when moving along with the surface of common electrode 13. In some embodiments, a suitably supported blade or scraper 19 is located in the third or fourth quadrant of rotation of drum 11 to capture stray particles that may not have previously been collected into the successive bins formed between partitions 18.

In order to subject the particles moving along electrode 13 of drum 11 to the substantially simultaneous electrostatic charges and dielectric treatments, there is provided a plurality of spaced, elongated, electrically conductive electrodes 21 positioned in an arcuate array opposite and somewhat spaced apart from the surface of common electrode 13, said electrodes extending in an axial direction relative to drum 11. The length of electrodes 21 may be coterminus with the length of drum 11 or may be somewhat shorter than said drum. Preferably, the length of the electrodes should be somewhat larger than the length of discharge port 17 of hopper 14 so that all of the particles being discharged from said hopper will be subjected to the electrical fields established between electrodes 21 and common electrodes 13.

The circuitry for producing the electrical fields between electrodes 21 and common electrode 13 include a direct current (D.C.) source 26 connected by lead lines 27 and 28 to a double-pole, double-throw switch 29 having contact arms 31 and 32. Contact arms 31 and 32 coact with contacts 33 and 34, respectively, for producing one desired electrical polarity to be transmitted to the apparatus. Alternatively, when it is desired to reverse the polarity, switch arms 31 and 32 may be moved to contact terminals 36 and 37, respectively. Terminals 34 and 36 are both connected to ground and at the same potential as electrode 13.

Terminals 33 and 37 are connected together by line 38 which, in turn, is connected to lead line 39 grounded by way of condenser 41. Line 39 is connected by way of a radio frequency (RF) choke coil 44 to a common lead line 47 and thence through separate lead lines 48 to respective electrodes 21. The RF choke prevents radio frequencies from affecting the D.C. source.

Connected to electrodes 21 by way of common lead line 47 and through interconnected individual lead lines 48, line 47, and lead line 49, is a radio frequency (RF) generator 51, one terminal of which is connected to ground.

The number of electrodes 21 may be selected to provide the optimum RF electric field to be generated across the space between said electrodes and the electrode surface 13 of drum 11. Electrodes 21 may occupy a major portion of the first quadrant of rotation of the drum 11 or may extend beyond said first quadrant to a location which can be established empirically for optimum RF electric field treatment of the particles moving over said drum. When the particles move over the electrically conductive surface 13 of rotating drum 11, a charge is imposed upon said particles by the D.C. electrostatic field establshed between said surface and electrodes 21 which will cause said particles to adhere electrostatically to the rotating drum. Simultaneously, the RF electric field through which the particles pass will cause the latter to become heated at varying rates, depending upon the nature of the materials. When the particles become heated they lose their D.C. charge differentially and, concomitantly, lose their adherence to the drum and fall off into the various successive bins or receptacles formed by partitions 18 in accordance with their intrinsic dielectric characteristics.

In a batch mix of non-conductive dissimilar materials, each material will give up its charge in a time period proportional to the amount of heat generated within it by the RF electric field. The amount of heat generated by the RF electric field in any material is a function of its chemical and physical structure.

According to the present process, the mixture of dissimilar materials is deposited on a metallic belt or drum and is subjected to a D.C. electrostatic field whereby those particles are caused to adhere to the drum. Simultaneously with the electrostatic charging or directly thereafter, the materials are subjected to a time-varying electrostatic field or RF energy, whereby the materials are heated differentially to a degree where they will give up their respective electrostatic charges at a time rate proportional to the temperature absorbing characteristics of each type of material.

This rate is governed by the chemical and physical characteristics of each particle's energy absorbing ability. Thus, where there is a mixture of two or more different materials, each with its own characteristics dielectric constant and loss factor, each will absorb this radio frequency energy at a different rate and give up its charge at a different rate. As each material gives up its charge, it will fall from the drum or belt at a different time. Therefore, each material will fall into a respective bin in accordance with its characteristic drop-off time. Thus, differential separation of different types of non-conductive materials is achieved by the apparatus and process herein.

The electrodes used to impress the D.C. electrostatic field and the RF energy field upon the particulate material can be arranged in any suitable configuration. A typical electrode array would comprise a set of rods in parallel with the drum or belt equal to the width of the drum or belt, and located at a distance that will provide for the greatest transfer of power with the least chance of arc-over. These electrodes will then be connected together in such a manner as to eliminate standing waves or reduce them to a minimum. (Standing waves can cause nonuniform distribution of power to the material.) The electrodes can be common to both the RF source and the D.C. source, or they can be separate. If combined, an RF filtering system must be installed in the D.C. line to prevent RF heating of and damage to the D.C. electrostatic supply.

In order to achieve optimum performance of the apparatus and system herein, the number of electrodes, the spacing between the electrodes, the spacing between the electrodes and the drum, the shape of the electrodes, and the choice of input frequency, all may be adjusted and modified empirically.

ALTERNATIVE EMBODIMENTS

FIG. 3 shows an alternative circuit arrangement for the same operational system shown in FIG. 1 with the difference being embodied in a separate and isolated circuit for the production of the electrostatic charge upon the particles. This is accomplished, for example, by connecting D.C. source 26 to one or more electrostatic electrodes 56 by way of lead line 57.

In some operational contexts, it may be desirable to isolate the D.C. source from the radio frequency (RF) source; yet, because of the movement of the particles along the surface of drum 11, said particles will enter the RF electric field so rapidly that the same substantially simultaneous effect of both the electrostatic charge and the RF energy will be imparted to the particles which will behave in the same manner as described hereinbefore in connection with FIG. 1.

FIG. 4 discloses another alternative circuit arrangement for inducing the electrostatic charge and the radio frequency energy upon the particles as a modified form of the circuit disclosed in FIG. 3. In FIG. 4, the electrostatic charge is induced by the separate, isolated D.C. circuit acting through electrode 56. The RF electric field adjacent the surface of the rotating drum 11 is induced by two separate sets of alternately spaced electrodes 58 and 59, respectively. One set of electrodes 58 is connected by a suitable common lead line 61 to one branch of the tank coil 62 of the RF generator 63, while the other set of electrodes 59 is connected by a suitable common lead line 64 to the other branch of tank coil 62 which has a mid-tap 66 to ground.

Lead lines 61 and 64 are adjustably connectable to the respective branches of tank coil 62 whereby suitable balance is achieved in order to raise the potential between the sets of electrodes 58 and 59, respectively, and the drum, whereby maximizing the heating effect of the Rf electric field and reducing breakdown voltage to a minimum.

The system shown in FIG. 4 provides for a "stray field" heating arrangement giving more uniform heating and reducing arcing to the drum which is at ground potential relative to the balanced electrode system. Because of this, breakdown voltages to the drum are considerably higher than the breakdown voltage in the unbalanced system.

Where it is desired to induce an electrostatic charge upon all of the electrodes including the dielectric electrodes in the embodiment of FIG. 4, the electrical circuitry may be arranged as in FIG. 5 where all of the two sets of electrodes 58 and 59 are connected to electrode 56 and receive D.C. current from the D.C. generator 26. Here, also, a double branch choke coil 67 is provided to prevent any radio frequency energy from affecting the D.C. source. Lead line 57 from the D.C. source is connected to ground by way of capacitor 68 in order to return stray radio frequencies to ground. The circuits from lead lines 61 and 64 are provided with isolating capacitors 69 and 71, respectively, in order to prevent short circuiting of the D.C. supply by the tank circuit of the RF generator.

A further alternative embodiment of the system and apparatus herein is shown in FIG. 6 where the D.C. electrostatic charge is impressed upon the particles by a separate, isolated D.C. circuit by way of lead line 57 through electrode 72. It will be noted that electrode 72 is graphically illustrated as having a more or less sharp apex or knife edge directed toward, and spaced apart from, the surface of drum 11. This form of electrode, as well as other suitable forms well known in the art, may be utilized for intensifying the electrostatic charge being projected upon the moving particles. It is understood that such alternative forms of electrodes may be utilized in the other embodiments of the apparatus shown and described herein.

Instead of utilizing separate and spaced apart electrodes for generating the RF electric field through which the particles move along the surface of drum 11, there is shown in FIG. 6 a unitary arcuate plate 73, connected by way of lead line 74 to the tank coil 62 of the RF generator. Plate 73, which is spaced apart from and has substantially the same curvature as drum 11, extends substantially the axial length of the drum as do the separate electrodes shown in the previous embodiments.

Figure 7:
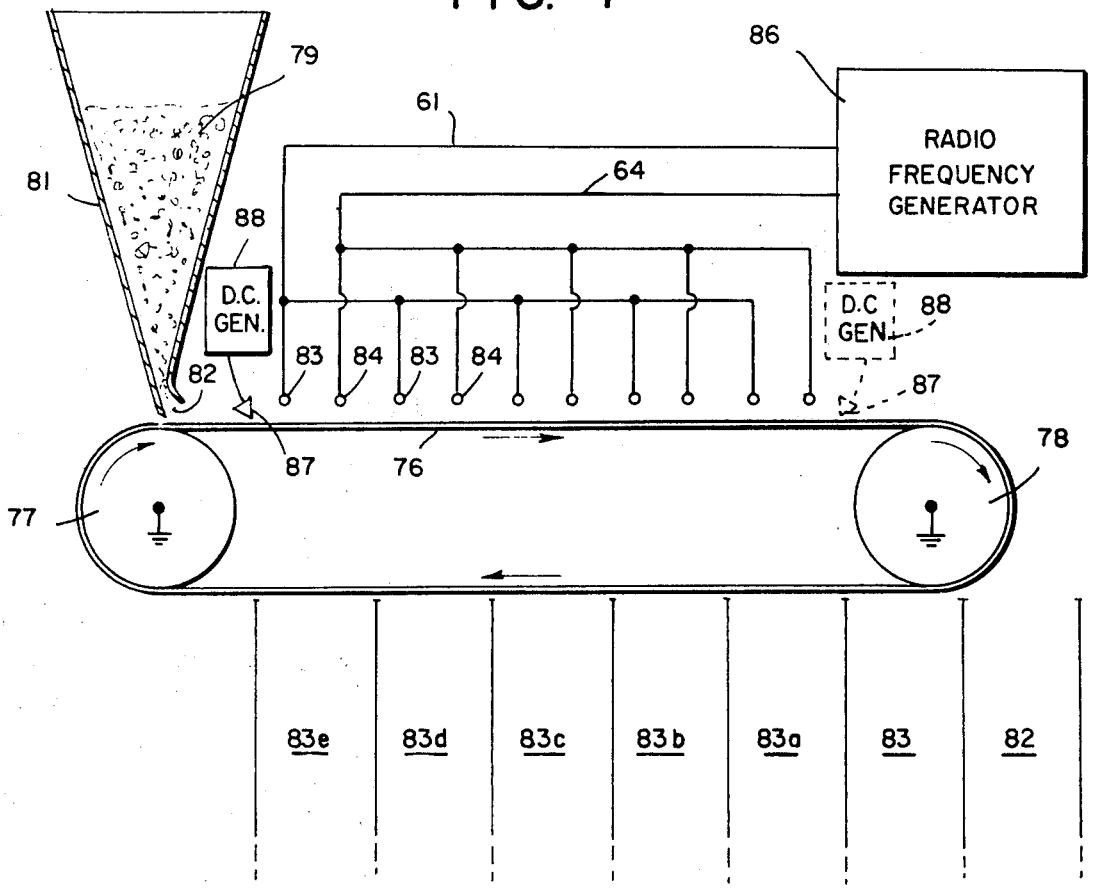
FIG. 7 is a diagrammatic side view of another embodiment of the invention incorporating an endless belt system.

FIG. 7 illustrates another embodiment of the invention which is operable with the same electrical components shown and described in connection with FIGS. 1–6, and which performs the separating process by way of an endless conveyor belt 76 mounted betweeen moved-around rollers 77 and 78. Belt 76 may be made of a suitable material which will perform the same function as the electrode surface 13 of drum 11 in FIG. 1.

Particulate materials 79 to be separated and originally stored within hopper 81 emerge from aperture 82 to become distributed along the moving belt 76. The particles move along the top surface of belt 76 within the RF electric heating field generated by sets of electrodes 83 and 84 which are connected to RF generator 86 similar to those described in connection with FIGS. 1–6. Located at one end of the array of electrodes 83–84 is an electrostatic electrode 87 connected to a suitable D.C. voltage source 88. Alternatively, the electrostatic electrode 87, shown in dotted outline, may be located in a position subsequent to the transit of the particulate materials past electrodes 83–84. Furthermore, the D.C. voltage may be applied through electrodes 83–84 in the same manner as shown in FIGS. 1 and 5.

The application of the D.C. voltage, either before, after, or in conjunction with the application of the RF electric heating field, is a matter of empirical choice. After being subjected to the electrostatic charge and the RF electric heating, the particulates pass over roller 78 and the electro-conductive materials therein will fall off first in a suitable bin 82 since they will not have adhered by electrostatic forces to belt 76. The remaining dielectric materials that pass around roller 78 on belt 76 will, in accordance with their charge loss characteristics, fall off said belt into separate, spaced bins 83*a, b, c, d, e.*

Although the present invention has been described with reference to particular embodiments and examples, it will be apparent to those skilled in the art that variations and modifications can be substituted therefor without departing from the principles and true spirit of the invention. The "Abstract" given is for the convenience of technical searchers and is not to be used for interpreting the scope of the invention or claims.

I claim:

1. The method for selectively separating different homogeneous types of particulate materials from a random heterogeneous mixture of two or more of said homogeneous types of materials where the combination dielectric constant and loss factor of each homogeneous type of material is different from that of the other homogeneous types of material in said mixture, which comprises placing a mass of said heterogeneous materials in motion on a materials carrier and subjecting said moving mass both to an electrostatic charge and to a radio frequency electric field, said materials becoming electrostatically charged and differentially heated in said fields in accordance with their respective combination dielectric constants and loss factors, said materials losing their respective electrostatic charges differentially in different intervals of time proportional to their respective combined dielectric constants and loss factors and consequently falling off said carrier into separate successive receptacles.

2. The method according to claim 1 wherein the electrostatic field is applied prior to the application of the radio frequency electric field.

3. The method according to claim 1 wherein the electrostatic field is applied after the application of the radio frequency electric field.

4. The method according to claim 1 wherein the electrostatic field and the radio frequency electric field are applied simultaneously.

5. The method according to claim 1 in which the electrostatic charge and radio frequency electric field are impressed and induced by means of an array of spaced electrodes located near said materials carrier and wherein said heterogeneous mixture is moved on said carrier past said array of electrodes for treatment thereby.

6. The method system according to claim 1 wherein said separated particulate materials are substantially in the same physical and chemical condition after passing through the system as when introduced into the system.

7. Apparatus for selectively separating different homogeneous types of particulate dielectric materials from a random heterogeneous mixture of two or more of said homogeneous types of materials which comprises a materials carrier on which said heterogeneous mixture moves, means located near said materials carrier for impressing an electrostatic charge upon the moving mixture of particles to cause adherence thereof on said carrier, and means located near said materials carrier for subjecting said materials to a radio frequency electric field to cause differential heating of said materials, said different types of homogeneous materials while in motion each successfully losing their respective electrostatic charges differentially in a time relationship proportional to their respective combination dielectric constants and loss factors, and consequently losing their adherence to and falling off said carrier in separate successive intervals of time.

8. The apparatus according to claim 7 wherein the means for generating the electrostatic charge and the radio frequency electric field comprises a plurality of spaced electrodes, said array of electrodes being spaced apart from the surface of said materials carrier, a D.C. generator connected to at least one of said electrodes and a radio frequency generator connected to at least one of said electrodes, said heterogeneous mixture being moved by said carrier past said array of electrodes for treatment thereby.

9. The apparatus according to claim 7 wherein the circuit for inducing the radio frequency electric field comprises two separate sets of electrodes spaced alternately in the array, a radio frequency generator, a tank coil in said radio frequency generator having a mid-tap to ground, one set of said electrodes being adjustably connected to one branch of said tank coil, and said other set of electrodes being adjustably connected to the other branch of said tank coil.

10. The apparatus according to claim 9 wherein the direct current source is connected to at least one separate electrode and to both of said sets of electrodes, and including a choke coil connected between said radio frequency generator and said direct current generator.

11. The method for selectively separating different homogeneous types of particulate dielectric materials from a random heterogeneous mixture of two or more of said homogeneous types of materials, which comprises placing a mass of said heterogeneous materials in motion on a materials carrier, subjecting said mass both to an electrostatic charge and to a radio frequency electric field thereby causing said materials to adhere to said moving carrier, said different types of homogeneous materials while in motion each successively losing their respective electrostatic charges differentially in a time relationship proportional in their respective combination dielectric constants and loss factors, and consequently losing their adherence to and falling off said carrier in separate successive intervals of time.

12. The method for selectively separating different homogeneous types of particulate materials from a random heterogeneous mixture of two or more of said homogeneous types of materials where each of said homogeneous types of materials has its own characteristic combination dielectric constant and loss factor, which comprises placing a mass of said heterogeneous materials in motion on a materials carrier and subjecting said moving mass both to an electrostatic charge and to a radio frequency electric field, said materials becoming electrostatically charged and differentially heated in said fields in accordance with their respective combination dielectric constants and loss factors, said materials losing their respective electrostatic charges differentially in different intervals of time proportional to their respective combined dielectric constants and loss factors and consequently falling off said carrier into separate successive receptacles.

13. The apparatus for selectively separating different homogeneous types of particulate materials from a random heterogeneous mixture of two or more of said homogeneous types of materials where each of said homogeneous types of materials has its own characteristic combination dielectric constant and loss factor, which comprises a materials carrier on which said heterogeneous mixture moves, means located near said materials carrier for generating and impressing an electrostatic charge upon the moving mixture of particles on said carrier, and means located near said materials carrier for subjecting said materials to a radio frequency electric field, said materials becoming electrostatically charged and differentially heated in said field in accordance with their respective combination dielectric constants and loss factors, said materials losing their respective electrostatic charges differentially in different intervals of time proportional to their respective combined dielectric constants and loss factors and consequently falling off said carrier to separate successive intervals of time.

* * * * *